US005372704A

United States Patent [19]

Harandi et al.

[11] Patent Number: 5,372,704

[45] Date of Patent: * Dec. 13, 1994

[54] CRACKING WITH SPENT CATALYST

[75] Inventors: Mohsen N. Harandi, Longhorne, Pa.; Hartley Owen, Worton, Md.

[73] Assignee: Mobil Oil Corporation, Fairfax, Va.

[ * ] Notice: The portion of the term of this patent subsequent to Oct. 13, 2009 has been disclaimed.

[21] Appl. No.: 859,756

[22] Filed: Mar. 30, 1992

Related U.S. Application Data

[63] Continuation-in-part of Ser. No. 749,483, Aug. 15, 1991, Pat. No. 5,154,818, which is a continuation of Ser. No. 527,985, May 24, 1990, abandoned.

[51] Int. Cl.[5] ..... C10G 51/02; C10G 11/02

[52] U.S. Cl. ..... 208/74; 208/75; 208/72; 208/73; 208/71; 208/67; 208/113; 208/120

[58] Field of Search ..... 208/74, 75, 67, 73

[56] References Cited

U.S. PATENT DOCUMENTS

| | | | |
|---|---|---|---|
| 2,541,795 | 2/1951 | Verley | 208/74 |
| 2,960,324 | 8/1959 | Patton et al. | 208/74 |
| 3,847,793 | 11/1974 | Schwartz et al. | 208/70 |
| 3,894,933 | 7/1975 | Owen et al. | 208/74 |
| 4,032,432 | 6/1977 | Owen | 208/70 |
| 4,090,948 | 5/1978 | Schwarzenbek | 208/74 |
| 4,218,306 | 8/1980 | Gross et al. | 208/120 |
| 4,310,489 | 1/1982 | Fahrig et al. | 208/153 |
| 4,417,974 | 11/1983 | Haunschild | 208/74 |
| 4,606,810 | 8/1986 | Krambeck et al. | 208/74 |
| 4,832,825 | 5/1989 | Mauleon et al. | 208/157 |
| 4,927,522 | 5/1990 | Herbst et al. | 208/120 |
| 5,154,818 | 10/1992 | Harandi et al. | 208/74 |

*Primary Examiner*—Helane Myers

*Attorney, Agent, or Firm*—Alexander J. McKillop; Malcolm D. Keen; Richard D. Stone

[57] ABSTRACT

A process and apparatus for low cracking or recracking of liquid hydrocarbons with FCC catalyst containing 0.2 to 1.5 wt % coke is disclosed. FCC naphtha, or a thermally or hydrocracked naphtha, contacts spent FCC catalyst in a naphtha recracking reactor for limited conversion to lighter products and an increase in octane number. Spent catalyst from the recracking reactor can be recycled to the FCC reactor without stripping or regeneration. Naphtha recracking products are preferably cooled, then used as an absorbent to recover gasoline boiling range products from the FCC main column overhead vapor. Use of spent catalyst and controlled conversion conditions minimizes overcracking of the light liquid and minimizes formation of heavy ends.

14 Claims, 1 Drawing Sheet

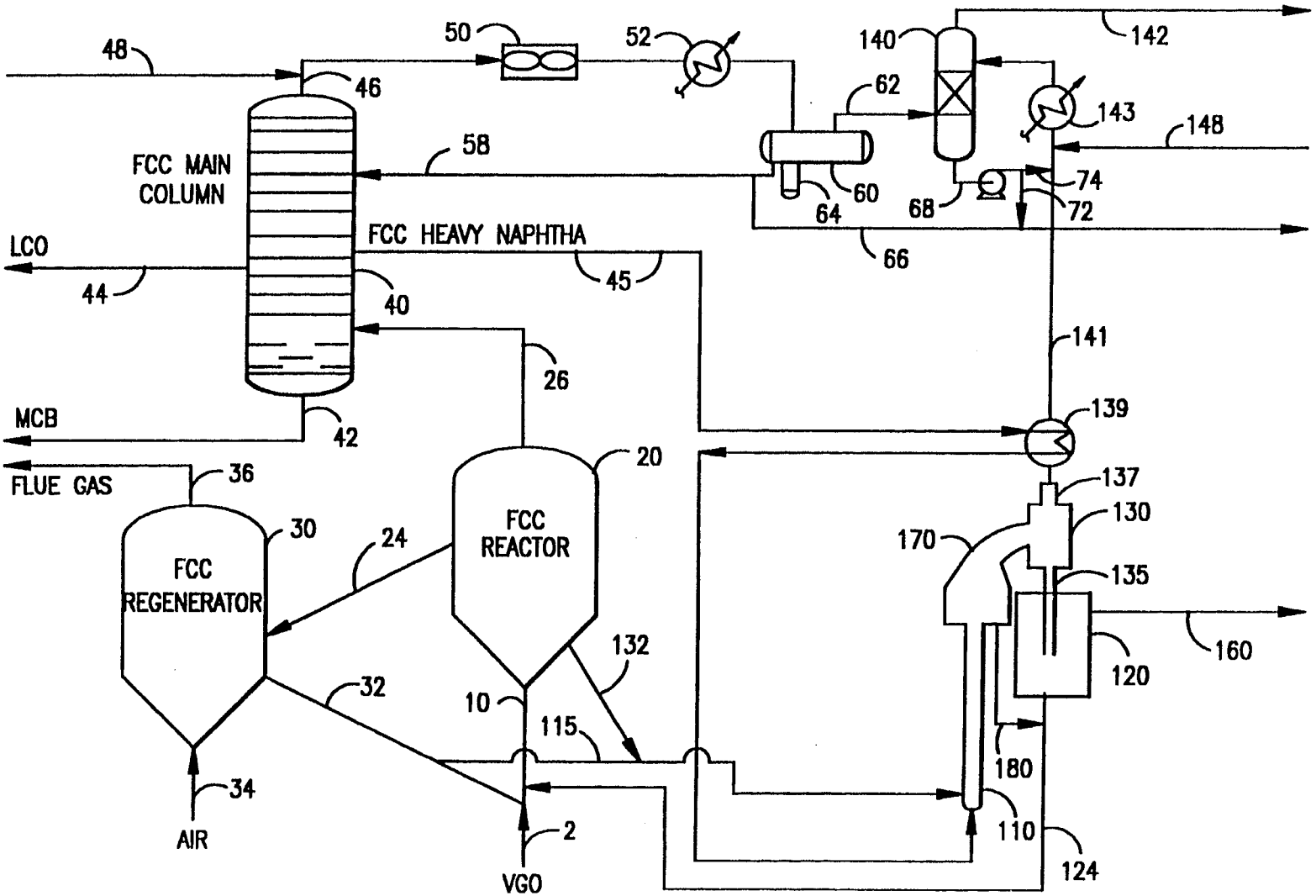
FCC REACTOR
FCC REGENERATOR
FCC MAIN COLUMN
FCC HEAVY NAPHTHA
VGO
AIR
FLUE GAS
MCB
LCO

CRACKING WITH SPENT CATALYST

CROSS REFERENCE TO RELATED APPLICATIONS

This application is a continuation-in-part of our prior copending application No. 749,483 filed Aug. 15, 1991 and now U.S. Pat. No. 5,154,818 granted Oct. 13, 1992, which is a continuation of Ser. No. 527,985, filed May 24, 1990 and now abandoned.

FIELD OF INVENTION

This invention relates to cracking relatively light liquid hydrocarbons, such as naphtha fractions, with spent cracking catalyst.

BACKGROUND OF THE INVENTION

Processes for the cracking of hydrocarbon feedstocks via contact at appropriate temperatures and pressures with fluidized catalytic particles are generically as "fluid catalytic cracking" (FCC). A heavy feed contacts not regenerated catalyst and is cracked to lighter products. Carbonaceous deposits form on the catalyst, thereby deactivating it. The deactivated (spent) catalyst is separated from cracked products, stripped of strippable hydrocarbons and conducted to a regenerator, where coke is burned off the catalyst with air, thereby regenerating the catalyst. The regenerated catalyst is then recycled to the reactor. The reactor-regenerator assembly are usually maintained in heat balance. Heat generated by burning the coke in the regenerator provides sufficient thermal energy for catalytic cracking in the reactor. Control of reactor conversion is usually achieved by controlling the flow of hot regenerated catalyst to the reactor to maintain the desired reactor temperature.

In most modern FCC units, the hot regenerated catalyst is added to the feed at the base of a riser reactor. The fluidization of the solid catalyst particles may be promoted with a lift gas. Mixing and atomization of the feedstock may be promoted with steam, equal to 1–5 wt % of the hydrocarbon feed. Hot catalyst (650° C.+) from the regenerator is mixed with preheated (150°–375° C.) charge stock. The catalyst vaporizes and superheats the feed to the desired cracking temperature usually 450°–600° C. During the upward passage of the catalyst and feed, the feed is cracked, and coke deposits on the catalyst. The coked catalyst and the cracked products exit the riser and enter a solid-gas separation system, e.g., a series of cyclones, at the top of the reactor vessel. The cracked products pass to product separation. Typically, the cracked hydrocarbon products are fractionated into a series of products, including gas, gasoline or naphtha, heavy gasoline or heavy naphtha, light gas oil, and heavy cycle gas oil. Some heavy cycle gas oil may be recycled to the reactor. The bottom's product, a "slurry oil", is conventionally allowed to settle. The catalyst rich solids portion of the settled product may be recycled to the reactor. The clarified slurry oil is a heavy product.

The "reactor vessel" into which the riser discharges primarily separates catalyst from cracked products and unreacted hydrocarbons and permits catalyst stripping.

Older FCC units use some or all dense bed cracking. Down flow operation is also possible, in which case catalyst and oil are added to the top of a vertical tube, or "downer," with cracked products removed from the bottom of the downer. Moving bed analogs of the FCC process, such as Thermofor Catalytic Cracking (TCC) are also known.

Further details of FCC processes can be found in: U.S. Pat. Nos. 4,093,537, 4,118,337, 4,118,338, 4,218,306 (Gross et al.); 4,444,722 (Owen); 4,459,203 (Beech et al.); 4,639,308 (Lee); 4,675,099, 4,681,743 (Skraba) as well as in Venuto et al., Fluid Catalytic Cracking With Zeolite Catalysts, Marcel Dekker, Inc. (1979). These patents and publication are incorporated herein by reference.

Conventional FCC catalysts usually contain acidic zeolites such as Rare Earth Y (REY), Dealuminized Y (DAY), Ultrastable Y (USY), Rare Earth Containing Ultrastable Y (RE-USY), and Ultrahydrophobic Y (UHP-Y).

Typical FCC catalyst particle diameters range from 20 to 150 microns, with an average diameter of 60 to 80 microns.

Catalysts used in moving bed catalytic cracking units (e.g. TCC units) are in the form of spheres, pills, beads, or extrudates, and can have a diameter ranging from 1 to 6 mm.

Although many advances have been made in both the catalytic cracking process, and the process produces close to half of the gasoline consumed in the United State, some problem areas remain.

The FCC gasoline pool has a fairly high octane number, but there is an ever increasing demand for more octane. The FCC gasoline is of good quality, but the volatility is somewhat higher than desired. End point restrictions have become more stringent to meet demands for clean burning fuel.

FCC gasoline, unlike reformate, has relatively large amounts of sulfur and olefins. Any attempts to reduce gasoline sulfur content by hydrotreating would also reduce gasoline octane number. The FCC heavy naphtha is especially troublesome re. sulfur, because the sulfur content increases with boiling point.

An additional concern in many areas is that there is not enough gasoline. This will an even more serious problem as new environmental regulations come into force, which may restrict the gasoline 90% boiling point to about 300° F. in some areas.

It would be beneficial if refiners had an efficient way to convert streams which are too heavy, or of poor quality, into products which could enter the refinery gasoline pool. FCC heavy naphtha is not as valuable as lighter naphtha.

Coker heavy gasoline is too heavy and too reactive to permit its inclusion in the gasoline pool.

Hydrocracked naphtha may not be suitable for blending in the gasoline pool, and may require further processing.

Virgin naphtha has a low octane number, and usually must be hydrotreated and reformed in a platinum reformer to permit addition to the refinery gasoline pool.

Refiners have used the FCC process as a way to upgrade to some extent one or more of these streams. Some methods of upgrading naphtha boiling range streams in FCC risers will be reviewed.

Coker naphtha has been added to an FCC riser, with much of it converted to coke.

U.S. Pat. No. 4,218,306, Gross et al., taught improving naphtha octane in a very bottom portion of a riser reactor, by contact with freshly regenerated catalyst.

In U.S. Pat. No. 4,832,825 an FCC light naphtha was recycled to the base of an FCC riser, to contact hot regenerated catalyst. The naphtha recycle was reported to double the production of light olefins.

In U.S. Pat. No. 3,847,793, Schwartz, which is incorporated herein by reference, C3 and C4 hydrocarbons, alone or in combination with a recycled gasoline fraction, were added to a dense bed reactor at the top of a riser reactor. This process is interesting because, although conducted in, or rather just downstream of, an FCC riser reactor, the conversion of C3/C4 and naphtha was apparently due solely to the action of ZSM-5 catalyst present in the inventory. The large pore cracking catalyst acted solely as a heat sink.

In the '793 process, the FCC catalyst inventory contained large amounts of ZSM-5, which retained activity during riser cracking. A heavy feed, such as a gas oil, was added to the base of a riser reactor and cracked. Resid, injected near the top of the riser, deactivated the large pore cracking catalyst. The riser discharged into a dense bed, where C3/C4, and optionally recycled gasoline, were added. The large pore catalyst provided a heat sink, while the ZSM-5 converted olefins and paraffins to lower boiling olefins and alkylbenzene and reduced the average weight of the alkylbenzene.

The '793 patent examples showed cracking of gasoline in a bench scale FCC unit at 960° F., 5 C/O, 0.2 WHSV, with catalyst coked to contain 2.66 to 2.7 wt % coke. The catalyst contained relatively large amounts of ZSM-5, e.g., 5% ZSM-5, 15% REY, all in a matrix. Roughly 60% yields of gasoline were obtained, with conversion of roughly 10 wt % of the feed to (coke and 450° F.+ material).

The '793 patent used the heat energy, but little or none of the catalytic activity, in "top of the riser" FCC catalyst. In U.S. Pat. No. 4,032,432, Owen, both the thermal energy and catalytic activity of this catalyst were used to oligomerize or cyclicize vapors from an FCC main column boiling below a C6+ gasoline stream. The catalyst specified was a mixture of large pore zeolite cracking catalyst and a smaller pore zeolite. In the process, a vapor fraction, having an average molecular weight of about 40, was heated, then charged to the base of a lift tube embedded in the reactor vessel containing the FCC spent catalyst stripper. The top of the lift tube discharged into a cyclone, having a vapor outlet isolated from the vapor products of the FCC reaction. The process reduced the requirements of the light ends recovery process by up to about 30%. The '432 patent thus showed a good way to convert light, normally vaporous hydrocarbons into heavier liquids, and to unload to some extent the light ends recovery facilities associated with FCC plants. The process did not act upon any normally liquid stream from the cracking unit.

Quenching of FCC risers with various liquid recycle streams is suggested in several patents. Light and heavy cycle oils, FCC naphtha, and water have all been proposed as quench liquids. Such quench fluids are considered relatively inert.

Processing of FCC heavy naphtha in a separate reactor, sharing a common regenerator with the FCC reactor, has been proposed.

We reviewed the problems of improving the quality of FCC gasoline, and trying to make more of it from various streams available in refineries, and found no completely satisfactory solution. The state of the art either did too much, or too little, to these streams.

Simply recycling naphtha to the base of an FCC riser, upstream of the point of fresh feed addition, or recracking the naphtha in a separate reactor with freshly regenerated cracking catalyst severely overcracks the naphtha. Large amounts of light olefins are produced, but gasoline boiling hydrocarbons are lost, a loss exceeding the potential yield of gasoline from alkylatable olefins produced during overcracking. The end point of gasoline can increase during recracking, due to thermal reactions. An additional problem is that the large amount of light ends produced will usually overwhelm the capacity of the FCC wet gas compressor and gas plant.

We wanted to recrack heavy naphtha, and similar refinery streams, without overcracking it. We wanted to decrease the FCC gasoline olefinicity and optionally the volatility of the gasoline. We wanted to decrease significantly the sulfur content and the 90% boiling point of heavy gasoline.

We also wanted a way to upgrade other relatively light streams, that is lighter than gas oil, without subjecting them to the severe FCC reaction conditions. We felt that something less severe than FCC processing was the optimum way to handle these relatively light liquids.

We discovered, in the FCC process, a catalyst with ideal properties for our purpose—FCC catalyst discharged from a riser reactor. This material is considered inactive or dead, but still retains considerable activity, and quite a lot of thermal energy. It has ideal properties for catalytic upgrading of FCC heavy naphtha, virgin naphtha and similar streams, but its potential has generally been ignored. Schwartz, in U.S. Pat. No. 3,847,793 realized some of the potential in FCC catalyst. He recognized its considerably residual activity and its value as a heat source. Schwartz, however, used it only for its heating value, preferring to eliminate its catalytic activity by adding a resid or equivalent heavy feed to essentially completely deactivate it with coke, while allowing the ZSM-5 present in the equilibrium catalyst to do its work.

We realized that spent FCC catalyst, because of its lower temperature, as compared to freshly regenerated FCC catalyst, does less thermal cracking. We believed that heavy naphtha could be converted by post-riser FCC catalyst, even using FCC catalyst which contained none, or only modest amounts of ZSM-5, and that coking of the FCC catalyst was neither essential nor beneficial. We believed that "top of the riser" FCC catalyst could crack heavy naphtha, without producing large amounts of light ends or high end point material.

We discovered a way to recrack light liquid hydrocarbon streams, using "top of the riser" cracking catalyst, without increasing catalyst traffic in the FCC reactor or catalyst stripper. In a preferred embodiment, our process and apparatus operates in unison with the FCC main column without significantly increasing vapor traffic in the column. We also discovered a way to continuously operate a separate fluidized bed reactor for naphtha recracking, without an additional catalyst regenerator, and/or a catalyst stripper. We were able to integrate an additional cracking process with the FCC process, but in a way which did not reduce the FCC unit's capacity nor impair its reliability.

BRIEF SUMMARY OF THE INVENTION

The present invention provides a catalytic cracking process for cracking a normally liquid, light hydrocarbon feed boiling below the gas oil range and a heavy liquid hydrocarbon feed comprising hydrocarbons boiling above 650° F. comprising: catalytically cracking said heavy feed in a catalytic riser cracking zone operating at catalytic cracking conditions including a severity sufficient to convert at least 50 wt % of the feed into lighter products by contacting said feed in the base of a riser reactor with a supply of hot regenerated cracking catalyst to produce a riser cracking zone effluent mixture having an effluent temperature and comprising cracked products and cracking catalyst containing less than 1.5 wt % coke and strippable hydrocarbons; separating in a reactor vessel said cracking zone effluent mixture into a cracked product vapor phase having an elevated temperature and a spent catalyst phase comprising catalyst containing less than 1.5 wt % coke; stripping in a stripping means at least a portion of said spent catalyst to produce stripped catalyst; regenerating, in a catalyst regeneration means operating at catalyst regeneration conditions, said stripped catalyst to produce a supply of hot, regenerated catalyst, recycling at least a portion of said regenerated catalyst to the base of said riser reactor to contact said heavy feed; removing said cracked product vapor phase from said reactor vessel via a transfer line and charging same to a main fractionator; fractionating the cracked product vapor into a spectrum of products including normally liquid hydrocarbons boiling below 650° F.; removing from said reactor vessel at least a portion of the spent catalyst containing less than 1.5 wt % coke and charging same to a recracking reactor vessel; charging said light, normally liquid hydrocarbon feed to said recracking reactor and catalytically cracking said light feed at low severity recracking conversion conditions selected to convert less than 30 wt % of the light feed to lighter components and to convert less than 10 wt % of the light feed to heavier products; recovering from said recracking reactor catalytically cracked products including gasoline boiling range hydrocarbons; and spent recracking catalyst; and recycling from said recracking reactor to said FCC riser reactor, FCC catalyst stripper, or FCC catalyst regenerator, said spent recracking catalyst.

In another embodiment, the present invention provides a method of increasing gasoline yields during riser catalytic cracking comprising: adding to the base of a riser cracking reactor preheated, heavy hydrocarbon feed comprising 650° F.+ hydrocarbons and a supply of hot regenerated cracking catalyst having a zeolite content of at least 20 wt % large pore zeolite, to form a mixture of feed and catalyst; cracking said feed at riser cracking condition to produce a mixture of cracked products comprising heavy naphtha boiling in the range of 300° to 425° F. and having an octane number and spent catalyst; separating said mixture in a reactor vessel downstream of said riser to produce a cracked product vapor phase and a spent catalyst phase containing less than 1.5 wt % coke; stripping said spent catalyst to produce stripped catalyst; regenerating at least a portion of said stripped catalyst to produce a supply of hot regenerated catalyst containing less than 0.2 wt % coke and recycling at least a portion of said hot regenerated catalyst to said riser cracking reactor; fractionating in an FCC main column said cracked products to produce cracked products including an FCC heavy naphtha product having an octane number and including hydrocarbons boiling in the range of 300° to 425° F.; charging at least a portion of said FCC heavy naphtha to a recracking reactor vessel; charging a stream of spent catalyst containing from 0.2 to 1.5 wt % coke from said FCC reactor vessel to said recracking reactor; catalytically recracking said FCC heavy naphtha at naphtha recracking conditions including a temperature of 800° to 1100° F., a catalyst: FCC heavy naphtha weight ratio of 1:1 to 20:1, and a vapor residence time of 1–100 seconds and sufficient to increase the octane number of said heavy naphtha fraction at least 2.0 and convert from 10 to 30 wt % of said FCC heavy naphtha to lighter products and spent recracking catalyst; separating in a catalyst/vapor separation means said catalytically recracked naphtha products from spent recracking catalyst; recovering catalytically recracked naphtha products; and recycling to said FCC unit said spent recracking catalyst.

In an apparatus embodiment, the present invention provides an apparatus for cracking a normally liquid, hydrocarbon feed boiling below the gas oil range and a heavy liquid hydrocarbon feed comprising hydrocarbons boiling above 650 F.° comprising: a riser reactor fluidized catalytic cracking means having a base portion with an inlet for a supply of hot regenerated cracking catalyst, an inlet for a source of heavy liquid feed, and an outlet in an upper portion thereof for discharge of cracked products and cracking catalyst containing less than 1.5 wt % coke and strippable hydrocarbons; a reactor vessel receiving said mixture discharged from said riser reactor, having a catalyst/cracked products separation means, which produces a cracked product vapor phase which is removed via a transfer line from said reactor vessel and a spent catalyst phase which collects in a lower portion of said vessel; a stripping means receiving spent catalyst from said reactor vessel and having at least one stripping gas inlet in a lower portion thereof and an outlet for stripped catalyst in a lower portion thereof; a catalyst regeneration means having an inlet connective with the stripped catalyst outlet, an inlet in a lower portion thereof for regeneration gas, and an outlet for hot, regenerated catalyst connective with said riser reactor means; a main fractionator having an inlet connective with the transfer line from said reactor vessel, a plurality of fractionated liquid product outlets and an overhead vapor outlet; an auxiliary cracking reactor means having an inlet for catalyst; an inlet for said light liquid hydrocarbon feed; and an outlet for recracked vapor products connective with an auxiliary cracking reactor transfer line; an auxiliary cracking reactor vapor cooling means operatively connected with said auxiliary cracking reactor transfer line and producing a cooled, auxiliary cracking reactor fluid; and a recontacting vessel means comprising: a vapor inlet connective with the overhead vapor outlet of said main fractionator; an inlet for said cooled auxiliary cracking reactor fluid; a vapor outlet in an upper portion thereof; and a liquid outlet in a lower portion thereof for a liquid stream of gasoline boiling range material.

BRIEF DESCRIPTION OF THE DRAWING

The FIGURE is a simplified schematic process flow of a preferred integration of a conventional FCC unit and a naphtha recracker of the present invention.

DESCRIPTION OF THE PREFERRED EMBODIMENTS

The process of the present invention involves a marriage of two process: fluidized catalytic cracking (FCC) and fluidized bed naphtha cracking and/or recracking. An overview of the two processes will be presented in conjunction with a review of the drawing, then additional details of the FCC process and the naphtha recracking process will be presented.

The FCC unit comprises FCC reactor 20, FCC regenerator 30, and FCC main column 40. Heavy feed, usually a gas oil or vacuum gas oil, perhaps containing 5–15 wt % resid, is charged via line 2 to the base of riser reactor 10. Hot regenerated catalyst from regenerator 30 is charged via line 32 to the base of the riser. Feed and hot catalyst pass up the riser 10 into FCC reactor vessel 20, where products are separated from spent catalyst, and little reaction occurs. Spent catalyst is separated from cracked products by conventional means. Spent catalyst is stripped in a catalyst stripping means within vessel 20, then discharged via line 24 to FCC regenerator 30. Regeneration air is added via line 34. Coke is burned from spent catalyst in the regenerator, producing flue gas which is removed via line 36 and hot regenerated catalyst recycled via line 32 to the base of riser reactor 10.

Hot cracked product is withdrawn from vessel 20 via line 26 and charged to the base of the FCC main column 40. Trays or packing are used to fractionate the cracked product vapor into a main column bottom, MCB, stream 42, sometimes called a slurry oil, one or more cycle oil products, such as a light cycle oil or LCO product withdrawn via line 44, a heavy naphtha stream withdrawn via line 45 and an overhead vapor stream withdrawn via line 46. A water wash stream may be added via line 48 to the overhead vapor. Conventional amounts of reflux may be recycled to upper portions of the column via line 58.

Overhead vapor is cooled in fin fan coolers 50, then in heat exchanger 52 and charged to 3 phase separator 60. Vapor is withdrawn via line 62, while hydrocarbon liquid is refluxed to the main column via line 58 or removed via line 66 as FCC "wild gasoline." Water collects in dropout boot 64 and is removed by means not shown. Vapor from separator 60 passes via line 62 into the suction of a wet gas compressor, not shown, in conventional FCC units.

The FCC processing steps described above are conventional. There are myriad variations in FCC processing which may be used, from different types of regenerators, different reactor designs, etc., but the underlying unit operations (cracking reaction, catalyst regeneration, product fractionation) will always be present.

The operation of the naphtha recracking unit, and its integration into the FCC unit, will now be described.

FCC heavy naphtha removed from the FCC main column via line 45 is charged to the base of naphtha cracking reactor 110, shown as a riser reactor. Spent catalyst from the FCC reactor, preferably after stripping, is charged via line 132 to the base of riser 110 leading to a dense phase fluidized bed reactor 170. The naphtha is recracked by contact with spent FCC catalyst in fluid bed reactor means 170. A portion of the catalyst is removed via line 180, while cracked naphtha products and entrained cracking catalyst are charged into sintered metals filters and/or cyclone separators 130. Products of naphtha cracking are removed via vapor outlet 137, while recovered catalyst is discharged via dipleg 135 into vessel 120. Preferably a pressure balance line, such as line 160, connects the naphtha recracking reactor catalyst collecting vessel 120 to the FCC reactor vessel 20. This helps keep pressures similar in both vessels. We prefer to operate the naphtha recracking reactor at a slightly lower pressure than the cracking reactor.

Catalyst may be stripped, but this is neither essential, nor preferred. Preferably recovered catalyst is simply recycled via line 124 to the base of the riser reactor 10. The thoroughly spent catalyst will have little activity in the FCC riser reactor, but can get a "free ride" up into vessel 20 where it may be stripped and then sent into the regenerator. The size of the catalyst stream in line 132, or in line 124, is usually quite small compared to the amount of the regenerated catalyst in line 32.

Larger catalyst circulation to the recracking reactor via line 132 can be tolerated, and may be beneficial. Additional catalyst circulation will moderate the FCC riser reactor temperature drop, and also remove heat from the FCC system. The heat removed can be the heat of the naphtha (or other light hydrocarbon) cracking reaction.

To provide additional control over reaction conditions for naphtha cracking, or recracking, some hot regenerated catalyst from the FCC regenerator may be sent directly via line 32 and 115 to riser 110 and/or reactor 170.

Products of naphtha recracking are preferably heat exchanged against heavy naphtha liquid feed in heat exchange means 139. The cooled material is then charged via line 141 through heat exchange means 143 and into contactor 140. A water wash stream 148 may be added to the cooled cracked vapor stream. Preferably a recycled contactor bottoms liquid is added via line 74 to this stream.

In contactor 140 the uncondensed vapors from the FCC main column contact the naphtha recracking products. Uncondensed vapors pass via line 142 to the FCC wet gas compressor, not shown. Liquids are removed via line 68. Contactor liquid may be removed via line 72 to mix with the FCC "wild gasoline" product in line 66, or recycled via line 74 to contact vapor from naphtha recracking in line 141.

Contactor 140 can be a simple piece of equipment as shown, or a more elaborate distillation column. The design shown, a short section of tower packing, will usually be adequate because the unique naphtha cracking process of the present invention can be operated to create little or no heavy ends. There may be no need to isolate a heavy naphtha fraction from a lighter naphtha fraction in, or downstream of, contactor 140. The rough cut separation of vapor from liquid is adequate, because the unsaturated gas plant of the FCC unit, and the product recovery facilities associated with the FCC wild gasoline stream, are already designed to handle a spectrum of products in the gasoline and lighter boiling range.

When a different type of naphtha recracking process is used, e.g., when hot regenerated rather than spent catalyst is charged to the recracking reactor, it will be beneficial to have a more elaborate fractionator 140. In this way the heavy ends or "tail" created by higher temperature reactions in the recracking reactor can be removed as a product or returned to the FCC main column without contaminating the "wild gasoline" in line 62 with heavy ends.

It is also possible to direct stream 141 to the FCC main column, or preferably to the inlet to the fin fan cooler 50, by means not shown. This approach will reduce the capital cost of the present invention, but increase the load on the column or cooler 50.

More details will now be provided regarding the FCC process and the preferred naphtha recracking process, using spent FCC catalyst.

FCC RISER CRACKING CONDITIONS

The conditions in the FCC reactor are conventional. They will involve somewhat higher cat:oil ratios, because a slipstream of spent catalyst will usually be added from the naphtha cracking reactor, but this will typically be only 2–20% of the catalyst in the riser. Riser top temperatures of 900°–1150° F. may be used, preferably around 950°–1050° F.

FCC CATALYST

Conventional FCC catalyst, i.e., the sort of equilibrium catalyst that is present in most FCC units, can be used herein. The catalyst per se, forms no part of the present invention, although it is essential to have a significant large pore zeolite content on the catalyst. Amorphous catalysts are not suitable, as these materials retain little if any catalytic activity at the top of the riser.

Highly active catalysts, with high zeolite contents are preferred. Large pore zeolite contents in excess of 20 wt %, and preferably in excess of 30%, or 40wt % or mere, are beneficial. Individual economics will determine if there is better profit potential at a refinery from working equilibrium catalyst a bit harder or going to more active catalyst, or to a higher zeolite content catalyst.

ADDITIVE CATALYSTS

In many instances it will be beneficial to use one or more additive catalysts, which may either be incorporated into the conventional FCC catalyst, or added to the circulating inventory in the form of separate particles of additive.

ZSM-5 and/or zeolite beta are preferred additives, whether used as part of the conventional FCC catalyst or as a separate additive. High silica additives, such as ZSM-5 do not deactivate as quickly as the conventional catalyst in the riser. ZSM-5 is not only highly active, but also highly selective for naphtha recracking and so is a highly desirable additive for use herein.

When a shape selective cracking catalyst additive, such as any Constraint Index 1–12 zeolite, or preferably ZSM-5, is used, it preferably is added to the naphtha recracking reactor first. The virgin ZSM-5 or other additive catalyst will exert an influence on the recracking reaction far in excess of its concentration in the catalyst inventory in the recracking reactor. Adding ZSM-5 first to the naphtha recracking reactor, then allowing it to circulate into the cracking reactor may improve the selectivity of ZSM-5 additives in the FCC process, especially those having silica:alumina ratios of around 30:1 to 100:1. This can improve the selectivity of the ZSM-5 in the cracking reactor, leading to decreased production of dry gas and light ends in the riser cracking reactor relative to octane increase.

The virgin ZSM-5 catalyst, or other fresh zeolite catalyst added to the naphtha recracking reactor, may be heated by contact with fresh regenerated catalyst, but preferably is heated with spent or partially spent equilibrium catalyst. Spent or partially spent catalyst has more favorable characteristics in the recracking reactor than freshly regenerated catalyst.

FCC FEED COMPOSITION

The present invention is applicable for use with all heavy FCC feedstocks. The process can be used with distilled feeds such as gas oils or vacuum gas oils, or heavier feeds.

The feeds may be similar to those in U.S. Pat. No. 4,818,372 and U.S. Pat. No. 4,427,537 and contain over 10 wt % material boiling above 500° C. or more of such high boiling material. A mixture of resid, and conventional FCC recycle streams, such as light cycle oil, heavy cycle oil, or slurry oil, may be used.

RECRACKING REACTOR FEED

The feed to the recracking reactor can be any normally liquid hydrocarbon stream. Although FCC heavy naphtha is an ideal candidate for recracking in our reactor, many other liquid hydrocarbon streams can beneficially be cracked in our process. Virgin naphtha, hydrocracked naphtha, coker naphtha, visbreaker naphtha, pentanes, kerosine fractions and other distilled fraction may be used.

Hereafter this reactor will usually be referred to as the "recracking reactor". Strictly speaking, the reactor is a cracking reactor when a virgin hydrocarbon is fed to it, and a recracking reactor when a recycled material, such as heavy cat naphtha, is fed. The term "recracking reactor" at least will not be readily confused with the FCC reactor, which is also a cracking reactor. It should be understood that the process and apparatus of the present invention should not be restricted by this naming convention, and that both fresh and recycled feeds may be charged to the "recracking reactor."

Light cycle oil, LCO, and preferably the light ends of light cycle oil, LLCO, may also be part or all of the feed to the recracking reactor.

Many streams conventionally fed to the FCC reactor may be more efficiently upgraded in our recracking reactor; such streams might include easily crackable feedstocks such as furfural raffinate, even though such streams are quite heavy.

Some gas oil, or other 650° F. plus hydrocarbons, may be present in the feed to the recracking reactor, and can be converted to some extent therein, but this will not usually be the most efficient place to crack these materials.

While considerable local variation is permitted, in most refineries, the following products will have the following boiling ranges, °F., as determined by D-86 Engler distillation:

| Liquid Hydrocarbon | Suitable | Preferred | Best |
|---|---|---|---|
| Virgin Naphtha | 100–500 | 150–450 | 300–450 |
| Hydrocracked Naphtha | 100–500 | 150–450 | 300–450 |
| Light FCC Naphtha | 60–300 | 100–250 | 150–225 |
| Heavy FCC Naphtha | 200–500 | 250–450 | 250–400 |
| Light Cycle Oil (LCO) | 300–750 | 340–720 | 380–650 |
| Light LCO (LLCO) | 300–550 | 325–500 | 350–450 |
| Furfural Raffinate | 600–1300 | 625–1200 | 650–1000 |
| Coker Naphtha | 100–500 | 150–450 | 200–400 |

RECRACKING REACTOR

The recracking reactor may be any fluidized bed reactor, ranging from a bubbling fluidized bed, to a turbulent or fast fluid bed, to a transport reactor such as a riser reactor.

A turbulent or fast fluidized bed reactor is preferred. Preferably the naphtha feed and spent FCC catalyst are charged to the base of a riser reactor which directs the catalyst to the bottom of the turbulent or fast fluidized bed reactor. Preferred naphtha recracking conditions include a temperature of 800° to 1100° F., and a vapor residence time of 1–100 seconds. Most preferred recracking conditions include a temperature of 950° to 1050° F., and a vapor residence time of 10 to 50 seconds.

Regardless of the type of reactor used, the conditions are relatively mild and should be much less severe than those experienced in conventional FCC riser reactors. The recracking conditions should be sufficient to increase the octane number of the heavy naphtha fraction at least 2.0 octane number, and preferably about 3 or 4 octane numbers, and convert from 10 to 40 wt % of the FCC heavy naphtha to lighter products. This limited conversion is achieved partly by the use of relatively mild recracking conditions, and partly by the use of "spent" catalyst, discussed below

NAPHTHA RECRACKING CATALYST

The naphtha recracking reactor uses spent catalyst from the FCC reactor. We realized that modern zeolite catalyst, even though "spent" or containing a significant amount of coke, still retained quite a lot of catalytic activity, at least sufficient activity to achieve the limited conversion sought in our naphtha recracking process.

The naphtha recracking catalyst can be 100% spent FCC catalyst. The FCC catalyst from the the FCC stripper, or preferably upstream of the stripper, will be at a temperature close to the FCC riser outlet temperature, varying from perhaps around 900° to 1050° F. in some units, though usually 950° to 1025° F. This temperature is adequate in our process, because the recracking catalyst is not required to do a significant amount of cracking (endothermic) conversion, and the heavy naphtha feeds are both easy to vaporize and readily vaporizable when heat exchanged with recracked product vapor.

Some fine tuning of recracking catalyst activity and temperature is easily achieved by mixing some hot regenerated FCC catalyst with the FCC spent catalyst. It is important to keep a majority of the catalyst stream to the naphtha recracking reactor "spent", so that thermal cracking reactions and overcracking of naphtha can be avoided in the recracking reactor. Operation with a recracking catalyst mixture of 50 to 95 wt % "spent" and 5 to 50 wt % regenerated will give good results. Most operators will use mixtures of 55 to 90 wt % "spent" and 10 to 45 wt % regenerated catalyst.

Fresh FCC catalyst, and preferably the shape selective zeolite additives used in FCC, may be directly added to the recracking reaction system, and from there cascaded to the FCC.

The catalyst composition per se forms no part of the present invention, as our process used existing catalyst inventory borrowed from the FCC unit. Our process works especially well when the circulating inventory of FCC catalyst contains large amounts of ZSM-5, or other high silica, shape selective zeolites. Such shape selective zeolites resist deactivation in the FCC riser reactor, and are especially active in our naphtha recracking reactor.

NAPHTHA RECRACKING CATALYST/PRODUCT SEPARATION

Conventional separation means may be used to separate vapor products of naphtha recracking from doubly spent FCC catalyst. Use of a reactor design as shown in the FIGURE is preferred but not essential. When a bubbling bed reactor is used much less robust separation technology will be adequate.

NAPHTHA RECRACKING VAPOR/MAIN COLUMN VAPOR CONTACTING

One of the unique features of our process is that it can crack more feed (in the recracking reactor) and share some of the FCC main column, without increasing the vapor loading in the main column. We can even reduce the vapor feed rate to the FCC unsaturated gas plant and wet gas compressor. Usually more cracking leads to more light products, rather than less, but we found a way to integrate product recovery from naphtha recracking with product recovery from the FCC main column.

The hot cracked vapor from the naphtha recracking reactor is preferably cooled (most preferably by heat exchange with the recracking reactor feed, e.g., FCC heavy naphtha liquid from the FCC main column) and condensed and charged to the upper regions of a contacting drum. FCC main column receiver overhead vapor, which would normally be charged to the wet gas compressor, is sent to the base of the recontacting drum, and passed countercurrent to descending condensed liquid from the naphtha recracking reactor. The liquid recovers additional gasoline boiling range components present in the overhead vapor from the main column overhead receiver. The vapor from the main column overhead receiver helps strip out olefinic light ends present in the condensed liquid from the naphtha recracking reactor.

Operating in this way, our naphtha recracking reactor produces a "wild" FCC gasoline product of acceptable purity, without the need for an elaborate fractionator. The 90% boiling point of our recracked gasoline will be lower than that of the recracking reactor feed, because our recracking reactor can operate without making an appreciable amount of heavy ends. The initial boiling point is adequately controlled by contact with, or stripping with, vapor from the FCC main column overhead receiver.

Preferred Operating Conditions

| | Broad | Preferred | Optimum |
|---|---|---|---|
| Recracking Temp, °F. | 800–1100 | 850–1050 | 875–1025 |
| Cat/Oil | 1–20 | 4–12 | 5–10 |
| Residence Time, Sec. | 1–100 | 2–10 | 2–5 |
| Gasoline Feed BP, °F. | 175–500 | 200–450 | 200–400 |
| Pressure | Slightly lower than FCC | | |
| Catalyst Wt Ratios | | | |
| Spent | 100–50 | 95–55 | 90–60 |
| Regenerated | 0–50 | 5–45 | 10–40 |
| Wt % C Cat in Line 132 | 0.2–2 | 0.4–1.5 | 0.5–1.2 |
| Wt % C Cat in Line 124 | 0.4–15 | 0.6–8 | 1.2–3 |
| Conversion of HCN, Line 45 | LT 30% | LT 25% | LT 20% |
| Conversion of other HC | LT 80% | LT 50% | LT 35% |

Note:
HCN refers to heavy cat naphtha, in line 45. Other HC refers to other hydrocarbon streams, such as a hydrocracked naphtha or distilled fraction, which can beneficially be cracked at quite a high level of conversion.

The light hydrocarbon recracking process operates under conditions, and a severity, which are remote from conventional FCC riser cracking. Conversion is preferably severely limited when FCC heavy naphtha is recracked so that less than 30 wt % of the, e.g., gasoline boiling range material in the feed to the recracking zone is converted to lighter materials, preferably less than 25 wt %, and most preferably less than 20 wt %.

The catalyst used in naphtha recracking would be considered unsuitable for other recracking processes. The catalyst contains so much coke, as it is discharged from the top of the riser, that it would never be considered suitable for use in a conventional riser cracking reactor.

The combination of tempered activity (due to some coke deposition) and reduced temperature (relative to regenerated catalyst) can prevent formation of heavy ends. This combination of steps also yields some unusual results:

Flexibility to produce additional light olefins in the refinery

Flexibility to change the refinery gasoline to distillate ratio.

Flexibility to undercut the PtR charge to help the CHD product quality. The refinery gasoline to distillate ratio may be controlled by adjusting the LLCO or kero flow rate to the recracking reactor. This will unload the PtR, reduce the overall operating cost, and reduce the refinery gasoline end point.

Flexibility to process the heavy hydrocrackate in the FCC if the refinery has a hydrocracker.

Flexibility to process part of the PtR charge whenever the PtR is down or regenerating.

Flexibility to process higher sulfur VGO in the FCC.

Flexibility to process higher resid percentage in the FCC since more heat is removed from the FCC system by the recracker.

We claim:

1. A process for cracking a normally liquid, light hydrocarbon feed boiling below the gas oil range and a heavy liquid hydrocarbon feed comprising hydrocarbons boiling above 650° F. comprising:

a. catalytically cracking said heavy feed in a catalytic riser cracking zone operating at catalytic cracking conditions including a severity sufficient to convert at least 50 wt % of the feed into lighter products by contacting said feed in the base of a riser reactor with a supply of hot regenerated cracking catalyst to produce a riser cracking zone effluent mixture having an effluent temperature and comprising cracked products and cracking catalyst containing less than 1.5 wt % coke and strippable hydrocarbons;

b. separating in a reactor vessel said cracking zone effluent mixture into a cracked product vapor phase having an elevated temperature and a spent catalyst phase comprising catalyst containing less than 1.5 wt % coke;

c. stripping in a stripping means at least a portion of said spent catalyst to produce stripped catalyst;

d. regenerating, in a catalyst regeneration means operating at catalyst regeneration conditions, said stripped catalyst to produce a supply of hot, regenerated catalyst;

e. recycling at least a portion of said regenerated catalyst to the base of said riser reactor to contact said heavy feed;

f. removing said cracked product vapor phase from said reactor vessel via a transfer line and charging same to a main fractionator;

g. fractionating the cracked product vapor into a spectrum of products including normally liquid hydrocarbons boiling below 650° F.;

h. removing from said reactor vessel at least a portion of the spent catalyst containing less than 1.5 wt % coke and charging same to a recracking reactor vessel;

i. charging said light, normally liquid hydrocarbon feed to said recracking reactor and catalytically cracking said light feed at low severity recracking conversion conditions selected to convert less than 30 wt % of the light feed to lighter components and to convert less than 10 wt % of the light feed to heavier products;

j. recovering from said recracking reactor catalytically cracked products including gasoline boiling range hydrocarbons; and spent recracking catalyst; and k. recycling from said recracking reactor to said FCC riser reactor, FCC catalyst stripper, or FCC catalyst regenerator, said spent recracking catalyst.

2. The process of claim 1 wherein:

said light feed to said recracking reactor is a naphtha or heavy naphtha boiling range feed having an octane number; and low severity recracking conditions are sufficient to increase the octane number of said naphtha at least 2.0 and to convert from 10 to 30 wt % of said cracked naphtha or heavy naphtha fraction to lighter products and less than 7.5 wt % to heavier products.

3. The process of claim 1 wherein said light feed to said recracking reactor is a thermally or catalytically cracked naphtha or heavy naphtha fraction.

4. The process of claim 1 wherein said recracking reactor is a turbulent or fast fluidized bed reactor.

5. The process of claim 1 wherein said recracking reactor operates at naphtha recracking conditions including a temperature of 800° to 1100° F., a cat:naphtha feed weight ratio of 1:1 to 20:1, and a vapor residence time of 1–100 seconds.

6. The process of claim 1 wherein said recracking reactor is a riser reactor and operates at naphtha recracking conditions including a riser top temperature of 850° to 1050° F., a cat:naphtha feed weight ratio of 5:1 to 10:1, and a vapor residence time of 2–5 seconds.

7. The process of claim 1 wherein the recracking catalyst comprises a mixture of 50 to 95 wt % spent FCC catalyst and 5 to 45 wt % regenerated FCC catalyst.

8. The process of claim 1 wherein said light feed to said recracking reactor is a hydrocracked naphtha or heavy naphtha fraction.

9. The process of claim 1 wherein said light feed to said recracking reactor is a furfural raffinate.

10. The process of claim 1 wherein spent catalyst from said recracking reactor is returned to said FCC unit without stripping.

11. A method of increasing gasoline yields during riser catalytic cracking comprising:

adding to the base of a riser cracking reactor preheated, heavy hydrocarbon feed comprising 650° F.+ hydrocarbons and a supply of hot regenerated cracking catalyst having a zeolite content of at least 20 wt % large pore zeolite, to form a mixture of feed and catalyst;

cracking said feed at riser cracking condition to produce a mixture of cracked products comprising heavy naphtha boiling in the range of 300° to 425° F. and having an octane number and spent catalyst;

separating said mixture in a reactor vessel downstream of said riser to produce a cracked product vapor phase and a spent catalyst phase containing less than 1.5 wt % coke;

stripping said spent catalyst to produce stripped catalyst;

regenerating at least a portion of said stripped catalyst to produce a supply of hot regenerated catalyst containing less than 0.2 wt % coke and recycling at least a portion of said hot regenerated catalyst to said riser cracking reactor;

fractionating in an FCC main column said cracked products to produce cracked products including an FCC heavy naphtha product having an octane number and including hydrocarbons boiling in the range of 300° to 425° F.;

charging at least a portion of said FCC heavy naphtha to a recracking reactor vessel;

charging a stream of spent catalyst containing from 0.2 to 1.5 wt % coke from said FCC reactor vessel to said recracking reactor;

catalytically recracking said FCC heavy naphtha at naphtha recracking conditions including a temperature of 800° to 1100° F., a catalyst:FCC heavy naphtha weight ratio of 1:1 to 20:1, and a vapor residence time of 1–100 seconds and sufficient to increase the octane number of said heavy naphtha fraction at least 2.0 and convert from 10 to 30 wt % of said FCC heavy naphtha to lighter products and produce spent recracking catalyst;

separating in a catalyst/vapor separation means said catalytically recracked naphtha products from spent recracking catalyst;

recovering catalytically recracked naphtha products; and recycling to said FCC unit said spent recracking catalyst.

12. The process of claim 11 wherein the naphtha recracking catalyst is 50 to 95% spent FCC catalyst and 5 to 50% regenerated FCC catalyst.

13. The process of claim 11 wherein said FCC main column produces an overhead vapor fraction comprising gasoline boiling range hydrocarbons which is charged to the base of a recontacting vessel and said catalytically recracked vapor product is cooled and at least partially condensed to produce a recracked gasoline liquid phase, and at least a portion of the recracked gasoline liquid phase is charged to an upper portion of said recontacting vessel to adsorb and recover from said FCC main column overhead vapor fraction gasoline boiling range hydrocarbons and produce a recontacting drum liquid stream of recracked gasoline and recovered gasoline and a vapor stream.

14. The process of claim 11 wherein a liquid FCC heavy naphtha product from the FCC main column is heat exchanged with catalytically recracked vapor from said recracking reactor to produce a heat exchanged FCC heavy naphtha product which is charged to said recracking reactor.

* * * * *